US005615455A

United States Patent [19]

Sorensen et al.

[11] Patent Number: 5,615,455

[45] Date of Patent: Apr. 1, 1997

[54] CABLE TIE HAVING ENHANCED ABUTMENT WALL IN LOCKING HEAD

[75] Inventors: Soren C. Sorensen; Jens O. Sorensen, both of Cayman KAL, Cayman Islands

[73] Assignee: GB Electrical, Inc., Milwaukee, Wis.

[21] Appl. No.: 579,235

[22] Filed: Dec. 28, 1995

[51] Int. Cl.[6] ..... B65D 63/00

[52] U.S. Cl. ..... 24/16 PB; 24/17 AP

[58] Field of Search ..... 24/16 PB, 17 AP, 24/30.5 P; 248/74.3; 292/321, 322

[56] References Cited

U.S. PATENT DOCUMENTS

| | | | |
|---|---|---|---|
| 3,224,056 | 12/1965 | Joffe | 24/16 PB |
| 3,816,878 | 6/1974 | Fulton et al. | 24/16 PB |
| 4,188,004 | 2/1980 | Fulton et al. | 248/74 PB |
| 4,287,644 | 9/1981 | Durand | 24/16 PB |
| 4,897,899 | 2/1990 | Shely et al. | 24/16 PB |
| 5,146,654 | 9/1992 | Caveney et al. | 24/16 PB |
| 5,159,728 | 11/1992 | Bingold | 24/16 PB |
| 5,224,244 | 7/1993 | Ikeda et al. | 24/17 AP |

*Primary Examiner*—Victor N. Sakran
*Attorney, Agent, or Firm*—Edward W. Callan

[57] ABSTRACT

In a tie including an elongated tongue and a locking head having a movable pawl that is hinged at one side of the opening of the locking head across the opening from an abutment wall for locking engagement with a set of ratchet teeth on the tongue when the tip of the tongue has been inserted through the opening, the abutment wall is enhanced for withstanding a force that would tend to bow the abutment wall when the pawl forces the tongue against the abutment wall in response to a pulling force applied to the tongue in a direction opposite to the direction of insertion, but does not require as much material as would be required for an abutment wall that merely had increased thickness and, when the tie is made by injection molding, the abutment wall is not significantly subject to deformation when the injected plastic material cools. The abutment wall includes a plurality of apertures extending within the abutment wall approximately parallel to the direction of insertion, with apertures not being exposed to an abutment surface of the abutment wall and not being as wide as the pawl. The apertures are elongated and pairs of apertures extend along a common axis from opposite ends of the abutment wall but do not extend to join each other within the abutment wall. The abutment wall includes a plurality of the pairs of the apertures; and the apertures do not extend to within that portion of the abutment wall against which force is applied through the tongue by the lateral middle of the portion of pawl that contacts the tongue when the tongue is forced against the abutment surface by the pawl.

10 Claims, 1 Drawing Sheet

FIG.1 PRIOR ART
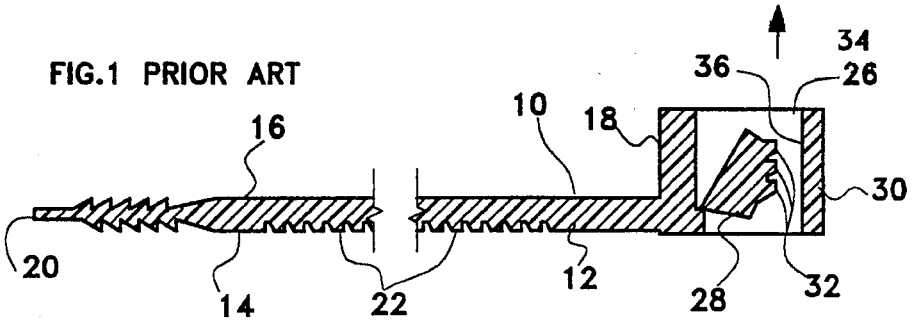
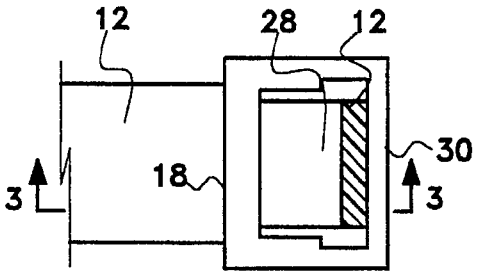
FIG.2 PRIOR ART
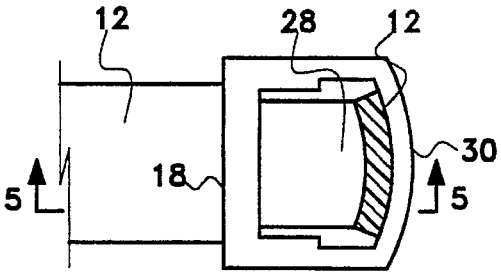
FIG.4 PRIOR ART
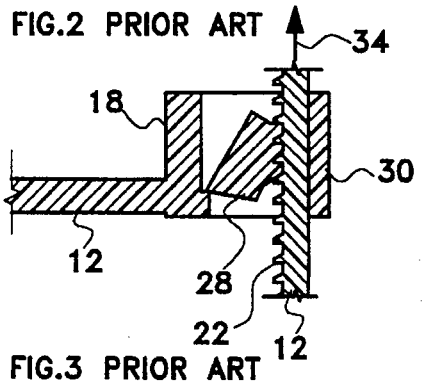
FIG.3 PRIOR ART
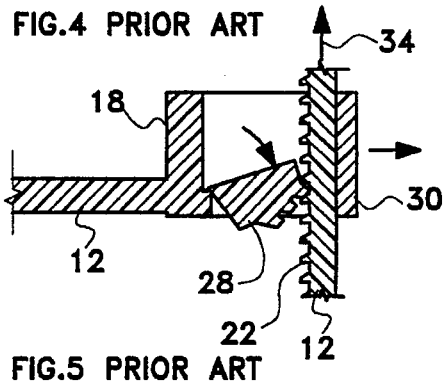
FIG.5 PRIOR ART
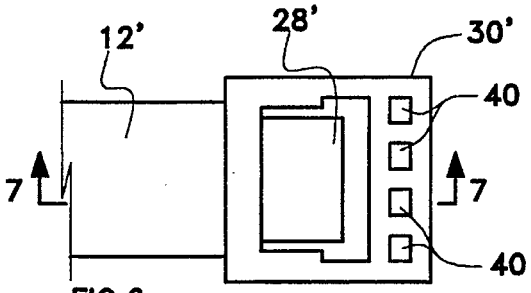
FIG.6
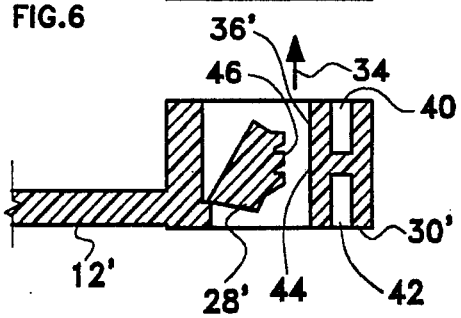
FIG.7

CABLE TIE HAVING ENHANCED ABUTMENT WALL IN LOCKING HEAD

BACKGROUND OF THE INVENTION

The present invention pertains to ties that are useful for forming a loop for retaining a bundle of elongated articles, such as cables and is particularly directed to an improvement in the abutment wall in the locking head of such ties. Such a tie is commonly known as a cable tie One type of tie 10, as shown in FIGS. 1, 2 and 3, includes an elongated tongue 12 with two ends and two broad sides 14, 16, a locking head 18 at one end of the tongue, a tip 20 at the other end of the tongue 12 and a set of ratchet teeth 22 extending along one broad side 14 of the tongue 12, wherein the locking head 18 has sides defining an opening 26 for receiving the tip 20 of the tongue 12. The sides include a movable pawl 28 that is hinged at one side of the opening 26 and an abutment wall 30 that is across the opening 26 from the pawl 28. The pawl 28 has pawl teeth 32 disposed for locking engagement with the set of ratchet teeth 22 when the tip 20 of the tongue 12 has been inserted through the opening 26 with the ratchet teeth 22 facing the pawl 28. When at least one pawl tooth 32 is so engaged, the pawl 28 is movable toward the abutment wall 30 in response to a pulling force applied to the tongue 12 in a direction opposite to the direction of insertion 34 in order to force the tongue 12 against an abutment surface 36 of the abutment wall 30. Such ties typically are made by injection molding plastic material into a mold defining cavities for forming the ties.

A problem arises incident to the use of the type of tie described above in that, if the pulling force applied to the tongue 12 in the direction 34 opposite to the direction of insertion 34 is too large, the pawl 28, which is in locking engagement with the ratchet teeth 22 on the tongue, is pulled toward the abutment wall 30 with such force as to cause the abutment wall 30 to bow outward, as shown in FIGS. 4 and 5. Consequently, when the abutment wall 30 bows outward, the pawl 28 continues to move toward the abutment wall 30 and eventually rotates about the hinge to such an extent that the pawl teeth 32 become disengaged from the ratchet teeth 22 and the tongue 12 is pulled out of the locking head 18. One solution to this problem is to increase the thickness of the abutment wall. However, this solution has the disadvantages of increasing the material in and thereby the unit cost of the tie and of subjecting the abutment wall of an injection molded tie to deformation when the injected plastic material cools.

SUMMARY OF THE INVENTION

The present invention provides a tie having an abutment wall that is enhanced for withstanding a force that would tend to bow the abutment wall when the pawl forces the tongue against the abutment wall in response to a pulling force applied to the tongue in a direction opposite to the direction of insertion, but does not require as much material as would be required for an abutment wall that merely had increased thickness, and which, when the tie is made by injection molding, is not significantly subject to deformation when the injected plastic material cools.

The tie of the present invention comprises an elongated tongue with two ends and two broad sides, a locking head at one end of the tongue, a tip at the other end of the tongue, and a set of ratchet teeth extending along one broad side of the tongue, wherein the locking head has sides defining an opening for receiving the tip of the tongue, the sides including a movable pawl that is hinged at one side of said opening and an abutment wall that is across the opening from the pawl; wherein the pawl has at least one pawl tooth disposed for locking engagement with the set of ratchet teeth when the tip of the tongue has been inserted through said opening with the set of ratchet teeth facing the pawl; wherein the pawl, when the at least one pawl tooth is so engaged, is movable toward the abutment wall in response to a pulling force applied to the tongue in a direction opposite to the direction of said insertion in order to force the tongue against an abutment surface of the abutment wall; and wherein the abutment wall includes one or more apertures extending within the abutment wall approximately parallel to the direction of said insertion, with the one or more apertures not being exposed to the abutment surface and not being as wide as the pawl.

Preferably, at least a pair of said apertures are elongated and extend along a common axis from opposite ends of the abutment wall but do not extend to join each other within the abutment wall; the abutment wall includes a plurality of said pairs of said apertures; and said apertures do not extend to within that portion of the abutment wall against which force is applied through the tongue by the lateral middle of the portion of pawl that contacts the tongue when the tongue is forced against the abutment surface by the pawl.

Additional features of the present invention are described with reference to the detailed description of the preferred embodiments.

BRIEF DESCRIPTION OF THE DRAWING

FIG. 1 is a fragmentary sectional view of a prior art tie.

FIG. 2 is a top plan view of a portion of the prior art tie of FIG. 1 further including a sectional view of the tongue within the locking head.

FIG. 3 is a sectional view taken along line 3—3 in FIG. 2 illustrating the locking engagement of the pawl and the ratchet teeth of the tongue within the locking head.

FIG. 4 is a top plan view of a portion of the prior an tie of FIG. 1 further including a sectional view of the tongue within the locking head and illustrating the abutment wall being bowed by a large force being applied thereto.

FIG. 5 is a sectional view taken along line 5—5 in FIG. 4 illustrating the locking engagement of the pawl and the ratchet teeth of the tongue within the locking head when the abutment wall is bowed by a large force being applied thereto.

FIG. 6 is a top plan view of the locking head and adjacent tongue portion of a preferred embodiment of a tie according to the present invention.

FIG. 7 is a sectional view of the locking head and adjacent tongue portion of a preferred embodiment of a tie according to the present invention taken along line 7—7 in FIG. 6.

DETAILED DESCRIPTION

Referring to FIGS. 6 and 7, in a preferred embodiment of a tie according to the present invention, the abutment wall 30' includes a plurality of elongated apertures 40, 42 extending within the abutment wall approximately parallel to the direction of insertion 34. The apertures 40, 42 are not exposed to the abutment surface 36' and none of the apertures 40, 42 is as wide as the pawl 28'. There are a plurality of pairs of apertures 40, 2, with each pair of apertures 40, 42 extending along a common axis from opposite ends of the abutment wall 30', as shown in FIG. 7, but not extending to join each other within the abutment wall 30'. None of the apertures 40, 42 extend to within that portion 44 of the abutment wall 30' against which force is applied through the tongue 12' by the lateral middle 46 of the portion of pawl 28' that contacts the tongue 12' when the tongue 12' is forced against the abutment surface 36' by the pawl 28'. Preferably, none of the apertures 40, 42 extend to within that portion 44 of the abutment wall 30' against which the largest force is applied when the tongue 12' is forced against the abutment surface 36' by the pawl 28'. The abutment wall 30' is thereby strongest in the portion 44 thereof against which the largest force is applied when the tongue 12' is forced against the abutment surface 36' by the pawl 28'.

Because the abutment wall 30' includes a plurality of apertures 40, 42 therein, the abutment wall 30' does not deform significantly when the tie is made by an injection molding process and the injected plastic material cools. The dispersal of the plurality of apertures 40, 42 within the abutment wall 30' enhances both the tendency against deformation and the strength of the abutment wall 30' to withstand forces that would tend to bow the abutment wall 30'.

In another preferred embodiment (not shown), the tie further includes a second set of ratchet teeth on the other broad side of the tongue and teeth on the abutment wall for locking engagement with the second set of ratchet teeth when the tip of the tongue is inserted through the locking head opening with the second set of ratchet teeth facing the abutment wall teeth. In other respects, this embodiment of the tie is the same as the embodiment described above with respect to FIGS. 6 and 7.

In an alternative embodiment (not shown), the abutment wall includes a single aperture extending within the abutment wall approximately parallel to the direction of insertion. Such aperture is not exposed to the abutment surface and is not as wide as the pawl. Such aperture does not extend to within that portion of the abutment wall against which force is applied through the tongue by the lateral middle of the portion of pawl that contacts the tongue when the tongue is forced against the abutment surface by the pawl. Preferably, such aperture does not extend to within that portion of the abutment wall against which the largest force is applied when the tongue is forced against the abutment surface by the pawl.

The advantages specifically stated herein do not necessarily apply to every conceivable embodiment of the present invention. Further, such stated advantages of the present invention are only examples and should not be construed as the only advantages of the present invention.

While the above description contains many specificities, these should not be construed as limitations on the scope of the present invention, but rather as exemplifications of the preferred embodiments described herein. Other variations are possible and the scope of the present invention should be determined not by the embodiments described herein but rather by the claims and their legal equivalents.

We claim:

1. A tie comprising an elongated tongue with two ends and two broad sides, a locking head at one end of the tongue, a tip at the other end of the tongue, and a set of ratchet teeth extending along one broad side of the tongue, wherein the locking head has sides defining an opening for receiving the tip of the tongue, the sides including a movable pawl that is hinged at one side of said opening and an abutment wall that is across the opening from the pawl;

wherein the pawl has at least one pawl tooth disposed for locking engagement with the set of ratchet teeth when the tip of the tongue has been inserted through said opening with the set of ratchet teeth facing the pawl;

wherein the pawl, when the at least one pawl tooth is so engaged, is movable toward the abutment wall in response to a pulling force applied to the tongue in a direction opposite to the direction of said insertion in order to force the tongue against an abutment surface of the abutment wall; and wherein the abutment wall includes one or more apertures extending within the abutment wall approximately parallel to the direction of said insertion, with the one or more apertures not being exposed to the abutment surface and not being as wide as the pawl for enhancing the abutment wall to withstand a force that will tend to bow the abutment wall.

2. A tie according to claim 1, wherein at least a pair of said apertures are elongated and extend along a common axis from opposite ends of the abutment wall but do not extend to join each other within the abutment wall.

3. A tie according to claim 2, wherein said pair of apertures do not extend to within that portion of the abutment wall against which force is applied through the tongue by the lateral middle of the portion of pawl that contacts the tongue when the tongue is forced against the abutment surface by the pawl.

4. A tie according to claim 2, wherein said pair of apertures do not extend to within that portion of the abutment wall against which the largest force is applied when the tongue is forced against the abutment surface by the pawl.

5. A tie according to claim 2, wherein the abutment wall includes a plurality of said pairs of said apertures.

6. A tie according to claim 5, wherein said apertures do not extend to within that portion of the abutment wall against which force is applied through the tongue by the lateral middle of the portion of pawl that contacts the tongue when the tongue is forced against the abutment surface by the pawl.

7. A tie according to claim 1, wherein at least one of said apertures does not extend to within that portion of the abutment wall against which force is applied through the tongue by the lateral middle of the portion of pawl that contacts the tongue when the tongue is forced against the abutment surface by the pawl.

8. A tie according to claim 1, wherein said apertures do not extend to within that portion of the abutment wall against which force is applied through the tongue by the lateral middle of the portion of pawl that contacts the tongue when the tongue is forced against the abutment surface by the pawl.

9. A tie according to claim 1, wherein at least one of said apertures does not extend to within that portion of the abutment wall against which the largest force is applied when the tongue is forced against the abutment surface by the pawl.

10. A tie according to claim 1, wherein said apertures do not extend to within that portion of the abutment wall against which the largest force is applied when the tongue is forced against the abutment surface by the pawl.

* * * * *